US009810477B2

(12) United States Patent
Sul et al.

(10) Patent No.: US 9,810,477 B2
(45) Date of Patent: Nov. 7, 2017

(54) REFRIGERATOR

(71) Applicant: SAMSUNG ELECTRONICS CO., LTD., Suwon-si, Gyeonggi-do (KR)

(72) Inventors: Nam Ki Sul, Suwon-si (KR); Jin O Kwak, Suwon-si (KR); Ju Seon An, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/946,262

(22) Filed: Nov. 19, 2015

(65) Prior Publication Data

US 2016/0282035 A1 Sep. 29, 2016

(30) Foreign Application Priority Data

Mar. 27, 2015 (KR) ..... 10-2015-0043152

(51) Int. Cl.
*A47B 96/04* (2006.01)
*F25D 23/06* (2006.01)
*F25D 27/00* (2006.01)

(52) U.S. Cl.
CPC ..... *F25D 23/062* (2013.01); *F25D 23/065* (2013.01); *F25D 27/00* (2013.01); *F25D 2323/021* (2013.01)

(58) Field of Classification Search
CPC ..... F25D 2600/04; F25D 2400/18; F25D 23/062; F25D 23/066; F25D 23/028; F25D 27/00; F25D 25/02
USPC ... 312/406, 406.1, 406.2, 407, 407.1, 257.1, 312/265.2, 265.3
See application file for complete search history.

(56) References Cited

U.S. PATENT DOCUMENTS 1,266,794 A * 5/1918 Gwyer ..... F25D 23/062 217/128
1,328,324 A * 1/1920 Gwyer ..... F25D 23/062 217/129
1,459,280 A * 6/1923 Card ..... F25D 23/062 217/128
1,933,242 A * 10/1933 Card ..... F25D 23/00 217/128
2,956,705 A * 10/1960 Clingman ..... A47B 47/0008 217/12 R
2,995,649 A * 8/1961 Cyrus ..... F25D 27/00 362/216
3,014,611 A * 12/1961 Marshall ..... F25D 23/064 220/592.1
3,380,615 A * 4/1968 Kessler ..... F25D 23/085 220/592.06

(Continued)

FOREIGN PATENT DOCUMENTS

JP 2014-32011 2/2014
JP 2014-126218 7/2014

*Primary Examiner* — Daniel J Troy
*Assistant Examiner* — Timothy M Ayres
(74) *Attorney, Agent, or Firm* — Staas & Halsey LLP

(57) ABSTRACT

A refrigerator, according to one embodiment, includes an inner case with an improved structure. The inner case includes a plurality of plates forming faces of the inner case, and one or more frames disposed between the plurality of plates to support the plurality of plates. The plates and the frames may be molded separately, without being molded as one body, so that the plates and the frames can be formed with various materials.

23 Claims, 14 Drawing Sheets

(56) References Cited

U.S. PATENT DOCUMENTS 3,688,384 A * 9/1972 Mizushima ..... A47B 47/042 220/592.1
3,813,137 A * 5/1974 Fellwock ..... F25D 23/066 220/592.1
4,006,947 A 2/1977 Haag et al.
4,030,870 A * 6/1977 Bunce ..... B29C 53/04 264/550
4,142,766 A 3/1979 Swerbinsky
4,378,137 A * 3/1983 Gibson ..... A47B 87/02 312/108
4,754,615 A 7/1988 Linstromberg
4,822,117 A 4/1989 Boston, Jr.
4,842,742 A 6/1989 Plante
4,872,589 A 10/1989 Englehart et al.
5,269,601 A 12/1993 Williams et al.
5,470,139 A * 11/1995 Hsiao ..... A47B 47/005 312/111
5,647,181 A * 7/1997 Hunts ..... A63H 33/10 312/111
5,797,514 A * 8/1998 Twiggar ..... F25C 5/182 220/683
5,893,620 A 4/1999 Birgelis
5,921,647 A * 7/1999 Schneider ..... A47B 47/05 211/187
6,112,542 A 9/2000 Lee
6,190,755 B1 2/2001 Addeo et al.
7,766,437 B2 * 8/2010 Lim ..... F25D 25/024 312/330.1
8,931,300 B2 * 1/2015 Smith ..... F25D 23/062 62/443
2003/0152765 A1 8/2003 Lewis
2007/0001563 A1 1/2007 Park et al.
2008/0205054 A1 * 8/2008 Ho ..... F21S 8/033 362/235
2009/0090734 A1 4/2009 Wittern, Jr. et al.
2010/0180615 A1 * 7/2010 Linder ..... A47F 3/0434 62/248

* cited by examiner

REFRIGERATOR

CROSS-REFERENCE TO RELATED APPLICATION

This application claims the benefit of Korean Patent Application No. 10-2015-0043152, filed on Mar. 27, 2015 in the Korean Intellectual Property Office, the disclosure of which is incorporated herein by reference.

BACKGROUND

1. Field

Embodiments of the present disclosure relate to an inner case of a refrigerator, and more particularly, to a refrigerator with an improved structure of an inner case.

2. Description of Related Art

In general, a refrigerator includes a main body including an inner case and an outer case, a storage room defined by the inner case, and a cool air supply apparatus to supply cool air to the storage room to keep food fresh.

The storage room is maintained at an appropriate range of temperature that is required to keep food fresh.

The storage room of the refrigerator opens at its front side, and the opened front side is closed by doors at ordinary time in order to maintain the temperature of the storage room.

The doors include door guides to keep stored goods, and are rotatably coupled with the main body by hinge units so as to be easily opened or closed.

Most of recently released refrigerators include additional configurations such as patterns or stainless structures in their outer cases to add beauty to the external appearances, in order to raise consumers' purchasing desires.

Also, there was a trial for raising the beauty of an inner case that a user sees when opening a refrigerator door, in addition to raising the beauty of an outer case. However, typically, since the inner case is integrally molded by vacuum molding, there was limitation in raising the beauty of the inner case.

SUMMARY

Therefore, it is an aspect of the present disclosure to provide a refrigerator with an improved structure of an inner case. The improved structure may, in one aspect, facilitate satisfaction of a user's esthetic sense.

Additional aspects of the disclosure will be set forth in part in the description which follows and, in part, will be obvious from the description, or may be learned by practice of the disclosure.

In accordance with one aspect of the present disclosure, a refrigerator includes: a main body; a storage room having an opening at one side; and an inner case defining the storage room, wherein the inner case includes: a plurality of plates forming faces of the inner case; one or more frames disposed between the plurality of plates to support the plurality of plates; and a cover member disposed around the opening to cover at least one of the one or more frames and the plurality of plates at a front part of the inner case.

Each frame may include at least two insertion grooves to enable at least two neighboring plates of the plurality of plates to be inserted into and supported by the frame.

The at least two insertion grooves of the frame may meet at a right angle.

The frame may extend in a longitudinal direction of one edge of the at least two plates inserted into the frame, and the insertion grooves of the frame may be formed in the longitudinal direction in which the frame extends.

The plurality of plates may include: an upper plate and a lower plate respectively forming an upper part and a lower part of the inner case; side plates forming both side parts of the inner case; and a back plate forming a back part of the inner case, and the one or more frames may be respectively disposed between the upper plate, the lower plate, and the side plates to support the plurality of plates.

The one or more frames may be respectively disposed between the upper plate, the lower plates, the side plates, and the back plate to support the plurality of plates.

Each frame may further include a first exposed part exposed to the inside of the inner case, and a lighting device may be disposed on the first exposed part.

The lighting device may be integrated with the frame.

The lighting device may be disposed on a frame located at the upper part of the inner case among the one or more frames.

A first supporting part which the plurality of plates are inserted into and supported by, and a second supporting part by which the one or more frames are supported may be formed on a rear part of the cover member.

The cover member may include a flange part extending from the inner case to the outside.

The inner case may further include one or more joints disposed at a back part of the inner case to support the plurality of plates and the one or more frames.

Each joint may include: three first supporting grooves by which at least three plates of the plurality of plates are respectively supported; and three second supporting grooves by which the one or more frames are respectively supported.

The three first supporting grooves of the joint may be formed at right angles with respect to each other.

In accordance with another aspect of the present disclosure, a refrigerator includes: a main body including a storage room; an inner case defining the storage room, wherein the inner case includes: a plurality of plates disposed to form faces of the inner case; and one or more frames disposed between two neighboring plates among the plurality of plates to support the two neighboring plates.

The one or more frames may include a plurality of insertion grooves which the plurality of plates are respectively inserted into and supported by.

The plurality of insertion grooves may be two insertion grooves, and the two insertion grooves may meet at a right angle.

The one or more frames may be disposed between the plurality of plates at an upper part of the inner case, and the one or more frames disposed at the upper part of the inner case may include a lighting device extending toward an inner part of the inner case.

The lighting device may be integrated with the one or more frames disposed at the upper part of the inner case.

The inner case may further include a cover member disposed in a front part of the inner case to support the plurality of plates.

A supporting part may be formed in a rear part of the cover member to support the plurality of plates and the one or more frames.

In accordance with another aspect of the present disclosure, a refrigerator includes: a main body; a storage room having an opening at one side; an inner case defining the storage room, wherein the inner case includes: a plurality of plates including an upper plate forming an upper part of the inner case, a lower plate forming a lower part of the inner case, side plates forming both side parts of the inner case, and a back plate forming a back part of the inner case; and a plurality of frames including a pair of upper frames disposed between the upper plate and the side plates to support both side edges of the upper plate and the side plates, a pair of lower frames disposed between the lower plate and the side plates to support both side edges of the lower plate and the side plates, and a back frame disposed between the back plate, the upper plate, the lower plate, and the side plates to support edges of the back plate, the upper plates, the lower plate, and the side plates.

The upper frame may include a lighting device integrated with the upper frame.

In accordance with another aspect of the present disclosure, a refrigerator includes: a main body having a storage room; an inner case defining the storage room, wherein the inner case includes: a plurality of plates forming faces of the inner case; one or more frames disposed between the plurality of plates to support the plurality of plates; a cover member disposed in a front part of the inner case to cover the one or more frames and the plurality of plates; and a lighting device disposed on a part of the one or more frames and integrated with the one or more frames.

BRIEF DESCRIPTION OF THE DRAWINGS

These and/or other aspects of the disclosure will become apparent and more readily appreciated from the following description of the embodiments, taken in conjunction with the accompanying drawings of which.

DESCRIPTION OF EMBODIMENTS

Figure 1:
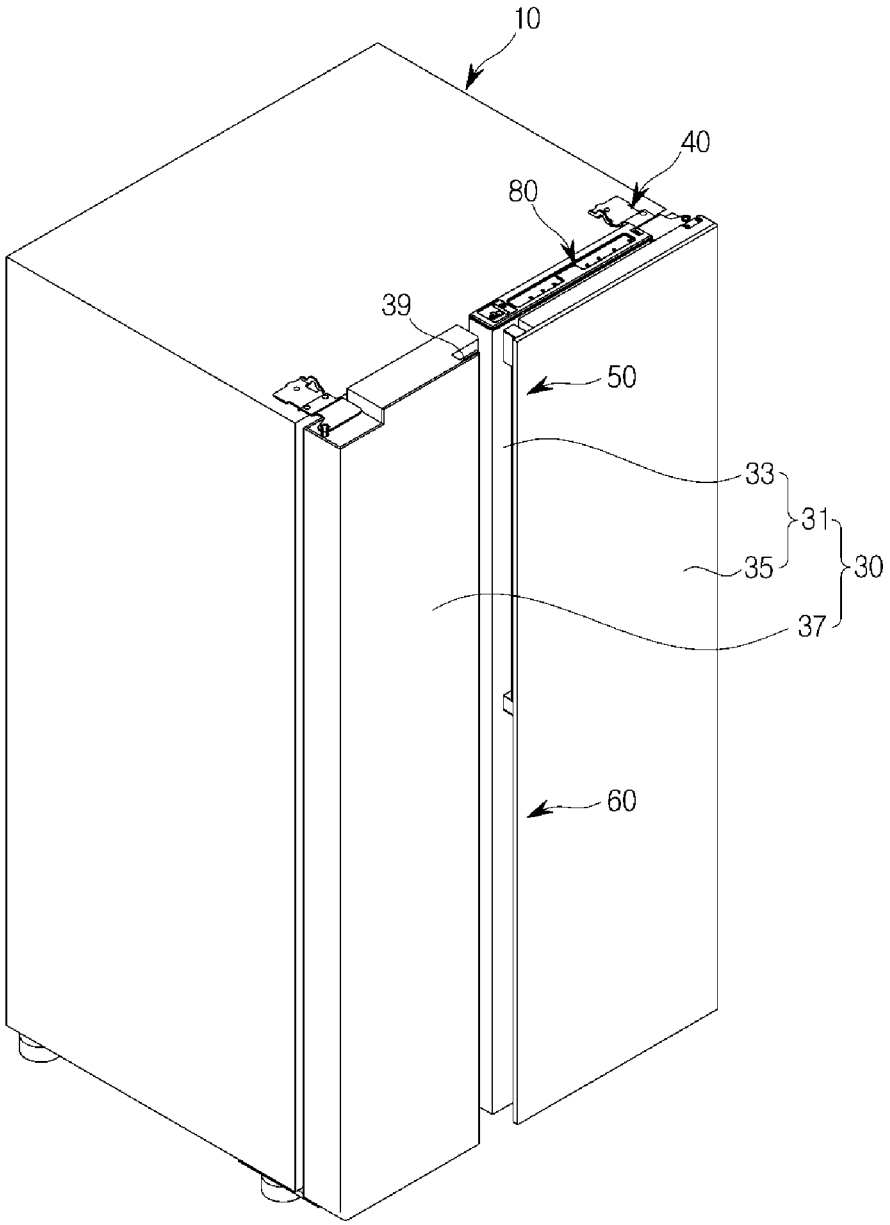
FIG. 1 is a perspective view of a refrigerator according to an embodiment of the present disclosure.

Reference will now be made in detail to the embodiments of the present disclosure, examples of which are illustrated in the accompanying drawings, wherein like reference numerals refer to like elements throughout.

In the following description, the terms "front part" and "front direction" mean the front part of a refrigerator main body and a direction toward the front part of the refrigerator main body, respectively, and also, the term "rear direction" means a direction toward the rear part of the refrigerator main body.

Figure 2:
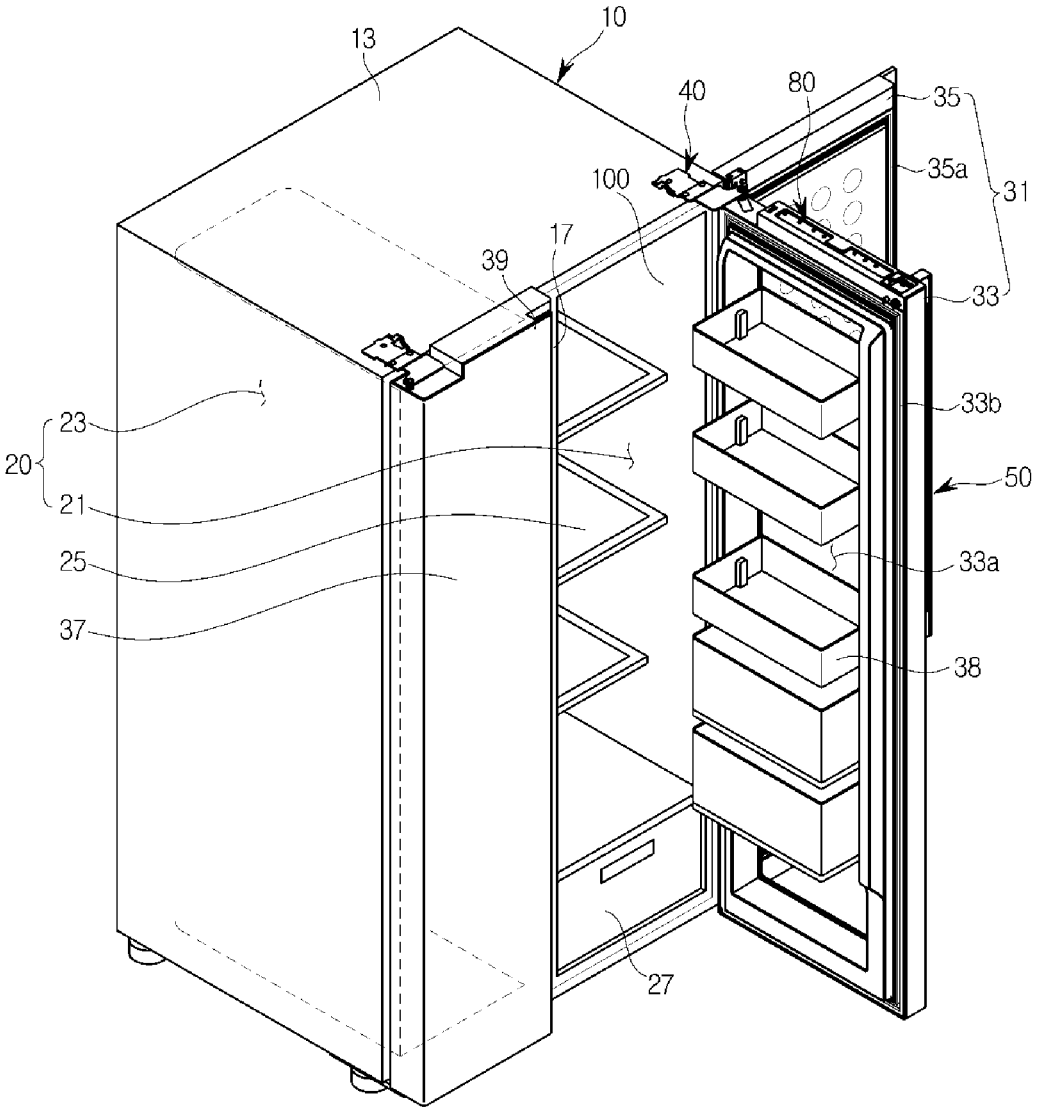
FIG. 2 is a perspective view of a refrigerator according to an embodiment of the present disclosure when both a first door and a second door of the refrigerator open.
Figure 3:
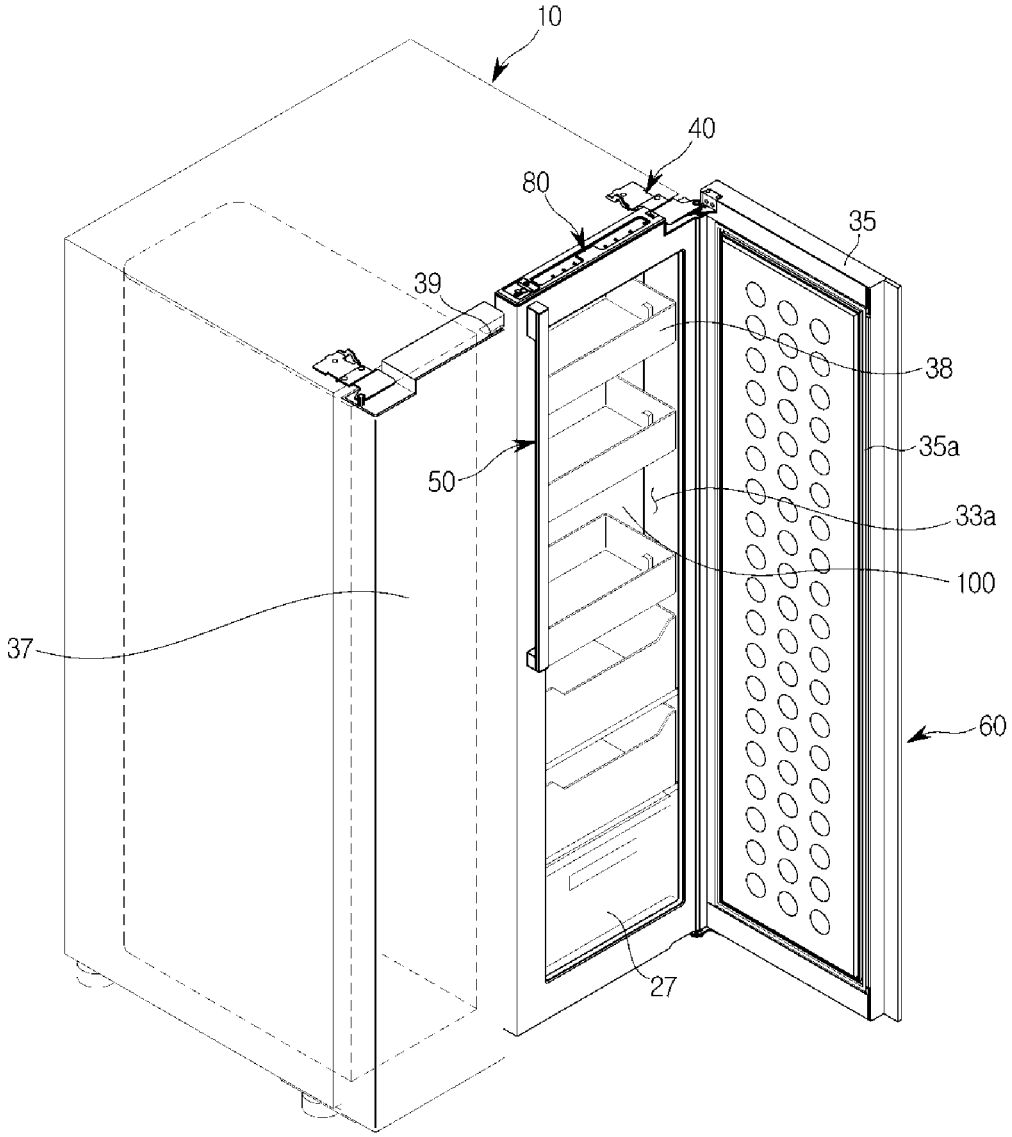
FIG. 3 is a perspective view of a refrigerator according to an embodiment of the present disclosure when a second door of the refrigerator opens.

As shown in FIGS. 1, 2, and 3, a refrigerator may include a main body 10, a storage room 20 formed in the inside of the main body 10 and having an opened front side, a plurality of doors 30 provided at the front part of the main body 10, rotatably coupled with the main body 10, and configured to open or close the storage room 20, and a plurality of hinge units 40 configured to enable the doors 30 to be rotatably coupled with the main body 10.

The main body 10 may include an inner case 100 forming the storage room 20, an outer case 13 forming an external appearance, and a cool air supplying apparatus (not shown) to supply cool air to the storage room 20.

The cool air supplying apparatus may include a compressor, a condenser, an expansion valve, an evaporator, a blow fan, and a cool air duct. An insulator may be foamed between the inner case 100 and the outer case 13 of the main body 10 in order to prevent cool air from escaping from the storage room 20. The insulator may also be foamed to the inside of the doors 30.

In the back, lower part of the main body 10, a machine room (not shown) may be disposed in which the compressor for compressing refrigerant and the condenser for condensing the compressed refrigerant are installed.

The storage room 20 may be partitioned into left and right space by a partition wall 17, wherein the right space of the storage room 20 is provided as a refrigerating compartment 21, and the right space of the storage room 20 is provided as a freezing compartment 23, as shown in FIG. 2, although not limited to this.

According to another example, the refrigerating compartment 21 and the freezing compartment 23 may be disposed vertically. Also, a single door 30 may be provided unlike the example shown in FIGS. 1, 2, and 3.

In the refrigerating compartment 21, a plurality of shelves 25 may be provided which partition the refrigerating compartment 21 into a plurality of areas and on which food, etc. can be put, and a storage container 27 may be provided to store food, etc.

The refrigerating compartment 21 and the freezing compartment 23 may be respectively opened or closed by a refrigerating compartment door 31 and a freezing compartment door 37 rotatably coupled with the main body 10. In order to enable the refrigerating compartment door 31 and the freezing compartment door 37 to be rotatably coupled with the main body 10, the hinge units 40 may be coupled with the top and bottom of the main body 10.

The refrigerating compartment door 31 may be rotatably coupled with the main body 10 at the front part of the main body 10. The refrigerating compartment door 31 may include a first door 33 having an opening 33*a*, and a second door 35 rotatably provided in front of the first door 33 and configured to open or close the opening 33*a*.

The size of the opening 33*a* may correspond to that of the refrigerating compartment 21, and a plurality of door guides 38 may be arranged across the opening 33*a*.

Since the opening 33*a* of the first door 33 has a size corresponding to the refrigerating compartment 21, the plurality of door guides 38 can be arranged across space corresponding to the entire of the refrigerating compartment 21 so that the plurality of door guides 38 can be all used by opening the second door 35.

The refrigerating compartment door 31 may include a plurality of refrigerating compartment door handles that a user grips to open or close the refrigerating compartment door 31, and the freezing compartment door 37 may include a freezing compartment door handle 39 that a user grips to open or close the freezing compartment door 37.

The refrigerating compartment door handles provided in the refrigerating compartment door 31 may include a first handle 50 attached on the front surface of the first door 33 to open or close the first door 33, and a second handle 60 attached on the second door 35 to open or close the second door 35.

On the rear surfaces of the refrigerating compartment door 31 and the freezing compartment door 37, a plurality of gaskets may be provided to prevent cool air from escaping from the storage room 20 by sealing between the main body 10 and the doors 30 when the refrigerating compartment door 31 and the freezing compartment door 37 are closed.

The gaskets provided in the refrigerating compartment door 31 may include a first gasket 33*b* disposed on the rear surface of the first door 33, and a second gasket 35*a* disposed on the rear surface of the second door 35. The magnetic force of a magnet (not shown) installed in the inside of the first gasket 33*b* may be greater than that of a magnet (not shown) installed in the inside of the second gasket 35*a* in order to maintain the first door 33 in a closed state when a user grips the second handle 60 to open the second door 35.

The first handle 50 may be attached on the front, upper surface of the first door 33, and the front surface of the first handle 50 may not protrude forward from the front surface of the second door 35 when the second door 35 is in a closed state.

The second handle 60 may be located below the first handle 50 when the second door 35 is in a closed state, and also, the front surface of the second handle 60 may not protrude forward from the front surface of the second door 35.

Hereinafter, the inner case 100 of the refrigerator will be described in detail. Since the inner case 100 forms the refrigerating compartment 21 and the freezing compartment 23 in the same shape, only the inner case 100 forming the refrigerating compartment 21 will be described below.

Figure 4A:
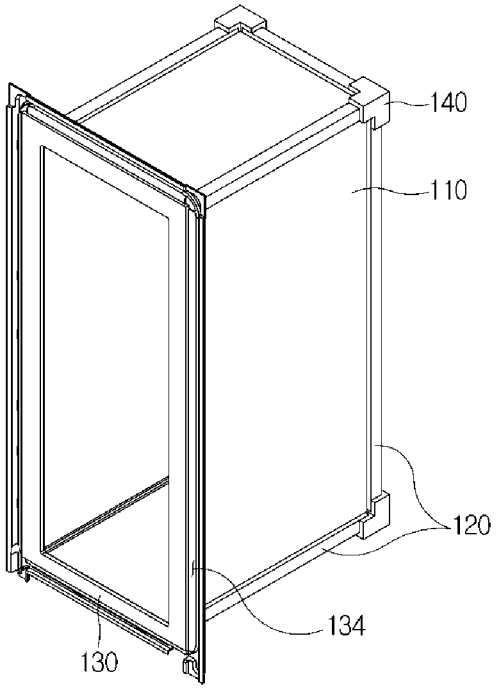
FIG. 4A is a perspective view of an inner case of a refrigerator according to an embodiment of the present disclosure.
Figure 4B:
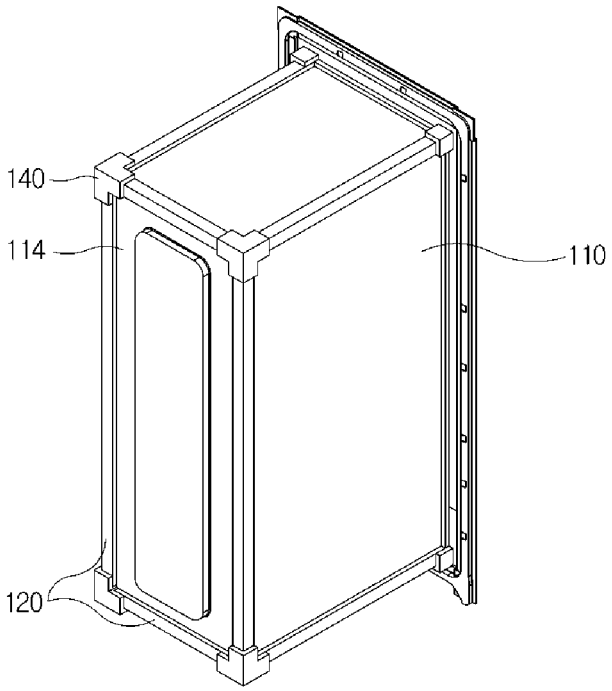
FIG. 4B is a perspective view of the inner case of FIG. 4A when seen from a different view point.
Figure 5:
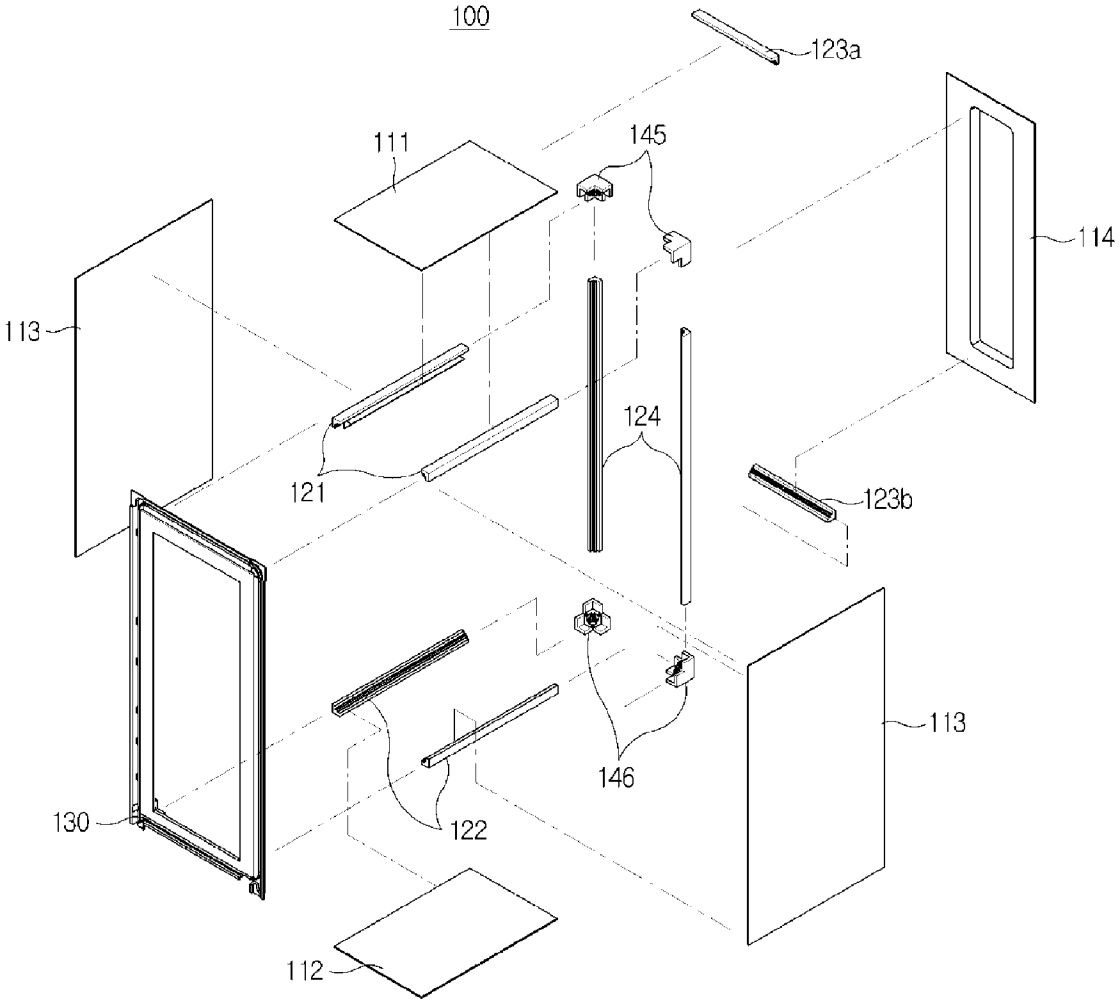
FIG. 5 is an exploded perspective view of an inner case of a refrigerator according to an embodiment of the present disclosure.

As shown in FIGS. 4A to 5, the inner case 100 may includes a plurality of plates 110 each having a rectangular shape and forming the faces of the inner case 100, an opening formed in the front part of the refrigerator, a plurality of frames 120 to support the plurality of plates 110, and a cover member 130 contacting the plurality of plates 110 and the plurality of frames 120.

The plurality of plates 110 may include an upper plate 111 forming the upper part of the inner case 100, a lower plate 112 forming the lower part of the inner case 100, side plates 113 forming both side parts of the inner case 100, and a back plate 114 forming the back part of the inner case 100.

Each plate 110 may form a face of the inner case 100 so that the inner case 100 can be formed in the shape of a six-sided object including an opening.

However, the inner case 100 may have another shape than a six-sided object, and the number of the plates 110 may depend on the shape of the inner case 100.

Each plate 110 may be formed in the shape of a rectangle using various kinds of molding methods including vacuum molding.

Figure 6:
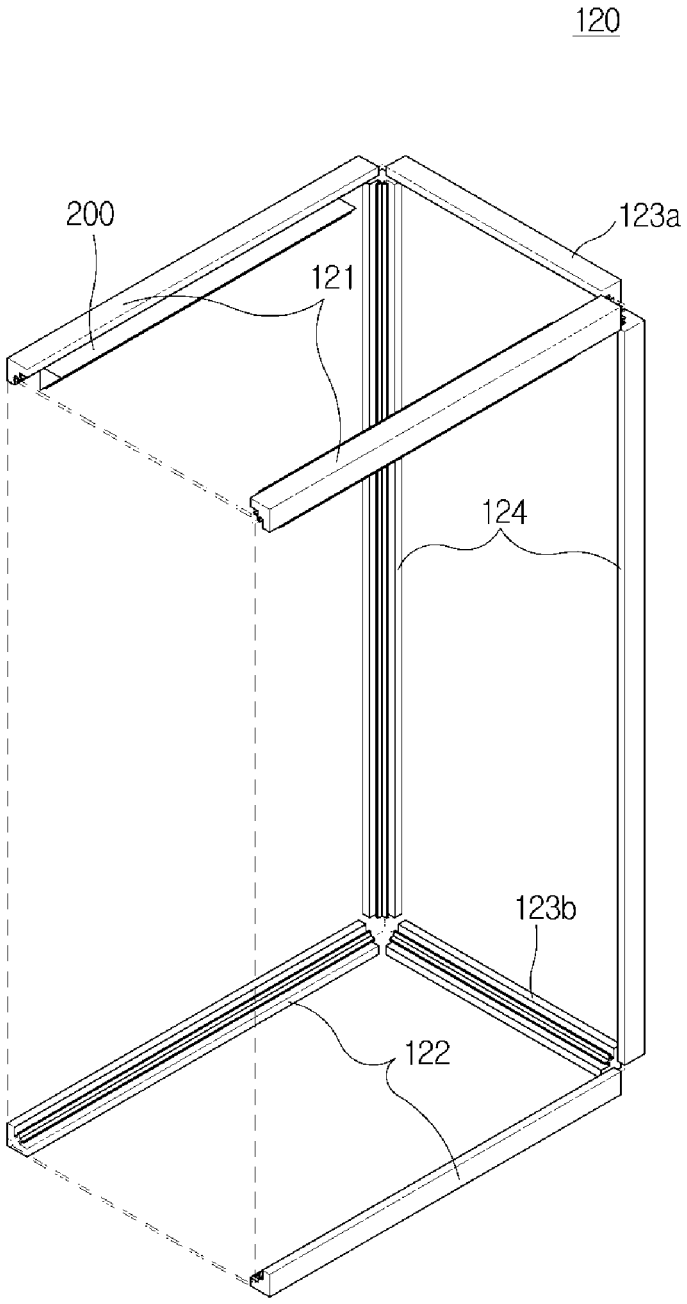
FIG. 6 is a front view of a frame included in an inner case of a refrigerator according to an embodiment of the present disclosure.
Figure 7:
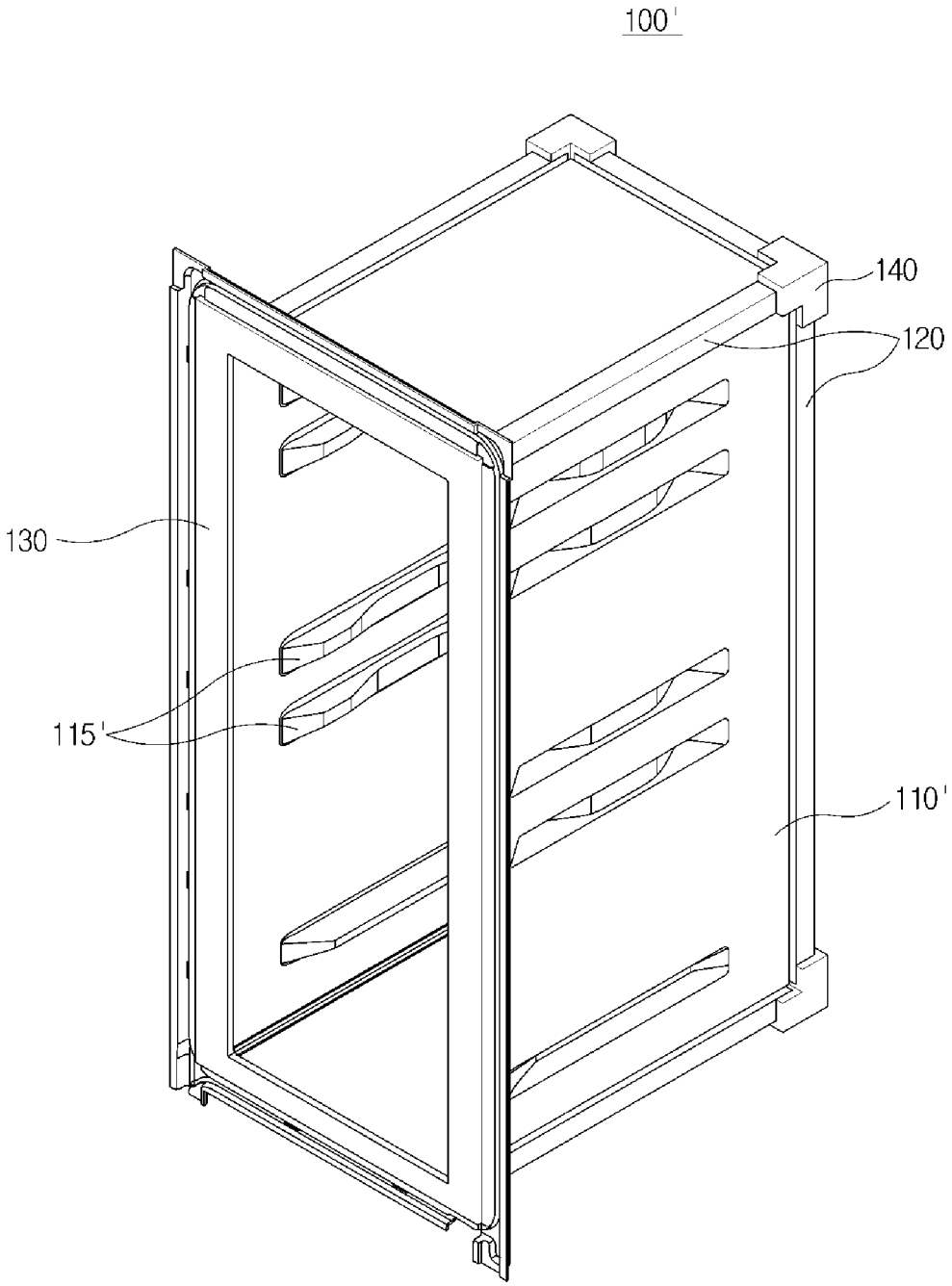
FIG. 7 shows an arrangement of a plurality of frames included in an inner case of a refrigerator according to an embodiment of the present disclosure.

As shown in FIGS. 5 to 7, the plurality of plates 110 may be supported by the plurality of frames 120 disposed between the plates 110, thus forming the faces of the inner case 100.

That is, the frames 120 may include a pair of upper frames 121 to support both side edges of the upper plate 111 and the upper edges of the pair of the side plates 113, a pair of lower frames 122 to support both side edges of the lower plate 112 and the lower edges of the pair of the side plates 113, a first back frame 123*a* to support the back edge of the upper plate 111 and the upper edge of the back plate 114, a second back frame 123*b* to support the back edge of the lower plate 112 and the lower edge of the back plate 114, and a pair of third back frames 124 to support both side edges of the back plate 114 and the back edges of the pair of the side plates 113.

Each frame 120 may support two plates 110 as described above. In order to maintain the inner case 100 in the shape of a six-sided object, each frame 120 may support two plates 110 in such a way for the two plates 110 to form a right angle.

Also, each frame 120 may extend to correspond to the edges of the plates 110 supported by the frame 120. However, the length of the frame 120 may be the same as or shorter than the lengths of the edges of the plates 110 supported by the frame 120.

The edges of the plates 110 extending from the frames 120 so as not to be supported by the frames 120 may be additionally supported by joints 140 which will be described later or by the cover member 130.

That is, the upper frames 121 may extend to correspond to both side edges of the upper plate 111 and the upper edges of the pair of the side plates 113, which are supported by the upper frames 121.

Also, the lower frames 122 may extend to correspond to both side edges of the lower plate 112 and the lower edges of the pair of the side plates 113, which are supported by the lower frames 122.

As shown in the current embodiment, since each plate 110 is in the shape of a rectangle, the upper and lower frames 121 and 122 may have the same length.

Likewise, the first back frame 123*a* may extend to correspond to the back edge of the upper plate 111 and the upper edge of the back plate 114, which are supported by the first back frame 123*a*.

Accordingly, since each plate 110 is in the shape of a rectangle, the first and second back frames 123*a* and 123*b* may have the same length.

The third back frames 124 may extend to correspond to the back edges of the pair of the side plates 113 and both side edges of the back plate 114. Accordingly, the lengths of the third back frames 124 may correspond to the height of the inner case 100.

The plates 110 may be partially inserted into the frames 120 and coupled with the frames 120. Accordingly, the frames 120 may include a plurality of insertion grooves 120*a* through which the plates 110 can be inserted into and coupled with the frames 120.

The insertion grooves 120*a* may extend to correspond to the edges of the plates 110 so that the edges of the plates 110 can be inserted into the insertion grooves 120*a*.

Since each frame 120 supports two plates 110 as described above, the frame 120 may include at least two insertion grooves 120*a*. Also, in order for the inner case 100 to be maintained in the shape of a six-sided object, the frame 120 may support the two plates 110 in such a way for the two plates 110 to form a right angle, and accordingly, the two insertion grooves 120*a* may be at a right angle.

Between the insertion grooves 120*a* being at a right angle may be provided a first exposed part 120*b*. The first exposed part 120*b* may be a part of the frame 120 exposed to the inside of the inner case 100. The first exposed part 120*b* may form the inner surface of the inner case 100 together with the plurality of plates 110.

That is, the five inner surfaces of the inner case 100, except for the opening of the inner case 100, may be formed by the plurality of plates 110, and a plurality of first exposed parts 120*b* may be provided at the corners between the plurality of plates 110 so that the inner surfaces of the inner case 100 can contact each other without making any gap.

On the first exposed parts 120*b* may be disposed a lighting device 200, which will be described in more detail, later.

As shown in FIGS. 4A and 7, the plurality of plates 110 may be supported by the plurality of frames 120 to form the inner case 100 in the shape of a six-sided object, and the inner case 100 may further include a plurality of joints 140 to support the frames 120 and the plates 110.

More specifically, the joints 140 may be provided in pairs at the upper and lower parts of the back plate 114. That is, four joints 140 may be disposed in pairs at the upper and lower corners of the back plate 114.

Figure 8:
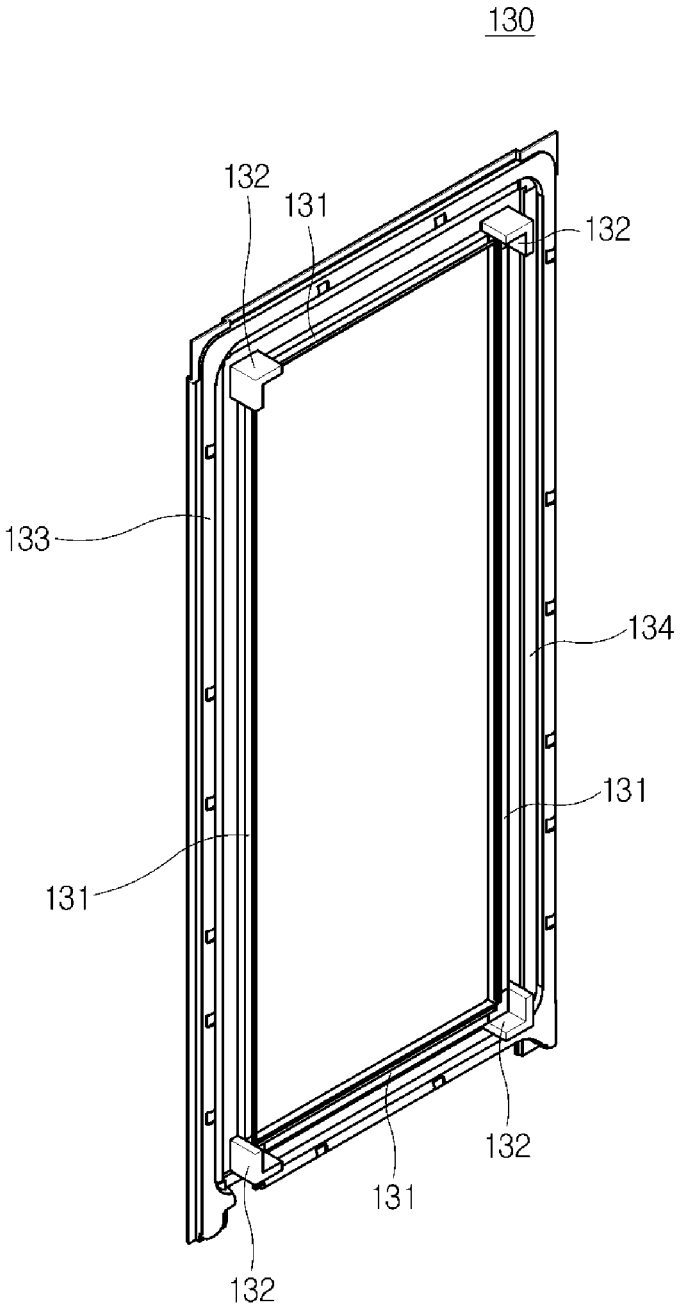
FIG. 8 is a perspective view of a joint included in an inner case of a refrigerator according to an embodiment of the present disclosure.

As shown in FIG. 8, each joint 140 may support three plates 110 and three frames 120 respectively coupled with the three plates 110. The joint 140 may be configured such that the three plates 110 and the three frames 120 meet at right angles with respect to each other.

The joint 140 may include three first supporting grooves 141 which the three plates 110 can be inserted into and supported by. That is, the corners of the three plates 110 may be inserted into the first supporting grooves 141. Accordingly, the first supporting grooves 141 may correspond to the corners of the plates 110 that are inserted into the joint 140.

Since the joint 140 supports the three plates 110 in such a way for the three plates 110 to be at right angles with respect to each other, the three first supporting grooves 141 may also be formed at right angles with respect to each other.

Also, a plurality of second supporting grooves 142 may extend from the first supporting grooves 141 in order to support the frames 120 coupled with the plates 110.

More specifically, three second supporting grooves 142 may be formed in the joint 140 in correspondence to the three first supporting grooves 141 to form space in which the three frames 120 are rested.

Since the three frames 120 are also arranged at right angles with respect to each other like the plates 110 as described above, the three second supporting grooves 142 may also be formed at right angles with respect to each other.

Figure 9:
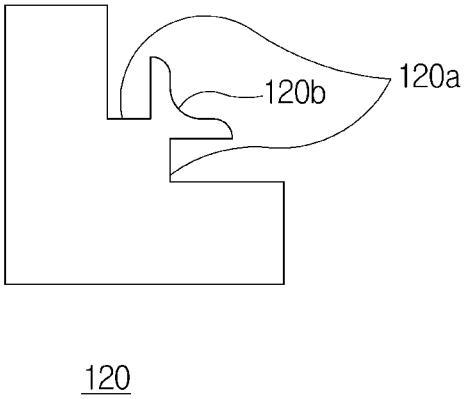
FIG. 9 shows a coupled state of a joint with a frame in an inner case of a refrigerator according to an embodiment of the present disclosure.

As shown in FIG. 9, when the joint 140, the frames 120, and the plates 110 are coupled, the frames 120 may be rested in the second supporting grooves 12 formed in the joint 140. Also, the corners of the plates 110 may be inserted into the first supporting grooves 141 extending toward the inner part of the joint 140 from the second supporting grooves 142.

That is, the first supporting grooves 141 may be provided as space into which the areas of the plates 110 not covered by the frames 120 upon coupling of the plates 110 and the frames 120 are inserted.

Accordingly, the back corners of the upper plate 111, the lower plate 112, and the pair of the side plates 113 and the four corners of the back plate 114 may be inserted into and supported by the joint 140.

More specifically, the back corners of the upper plate 111, the upper corners of the pair of the side plates 113, and the upper corners of the back plate 114 may be supported by the upper joints 145, and the back ends of the upper frames 121 coupled with the plates 110 supported by the upper joints 145, both ends of the first back frame 123*a*, and the upper ends of the third back frames 124 may be supported by the upper joints 145.

Also, the back corners of the lower plate 112, the lower corners of the pair of the side plates 113, and the lower corners of the back plate 114 may be supported by the lower joints 146, and the back ends of the lower frames 122 coupled with the plates 110 supported by the lower joints 146, both ends of the second back frame 123*b*, and the lower ends of the third back frames 124 may be supported by the lower joints 146.

When the frames 120 are rested in the joints 140, the first supporting grooves 141 and the insertion grooves 120*a* may interwork to support the edges of the plates 110. That is, since the first supporting grooves 141 and the insertion grooves 120*a* have the same width and depth, the first supporting grooves 141 and the insertion grooves 120*a* can support the plates 110 without making any gap when the frames 120 are rested in the second supporting grooves 142 to contact the second supporting grooves 142.

The joint 140 may further include a second exposed part 143 formed between the three first supporting grooves 141.

The second exposed part 143 may be a part of the joint 140 exposed to the inside of the inner case 100. The second exposed part 143 may form the inner surface of the inner case 100 together with the plurality of plates 110 and the first exposed parts 120*a*.

That is, the five inner surfaces of the inner case 100, except for the opening of the inner case 100, may be defined by the plurality of plates 110, the plurality of first exposed parts 120*b* may be provided at the corners between the plurality of plates 110, and a plurality of second exposed parts 143 may be provided at four edges of the back plate 114 of the inner case 100, that is, at the corners between the plurality of plates 110, so that the inner surfaces of the inner case 110 can contact each other without making any gap.

Figure 10:
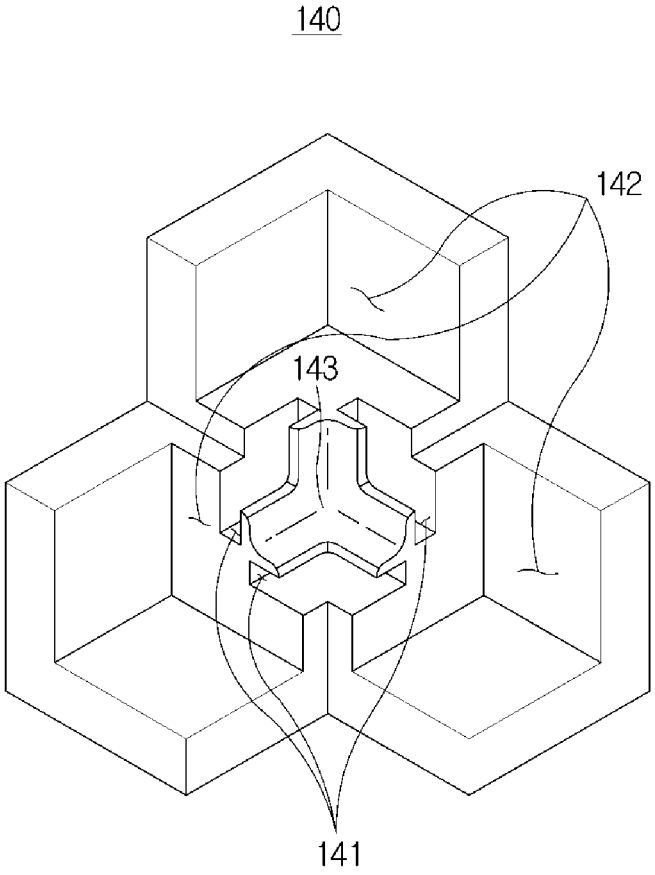
FIG. 10 is a perspective view of a rear part of a cover member included in an inner case of a refrigerator according to another embodiment of the present disclosure.
Figure 11:
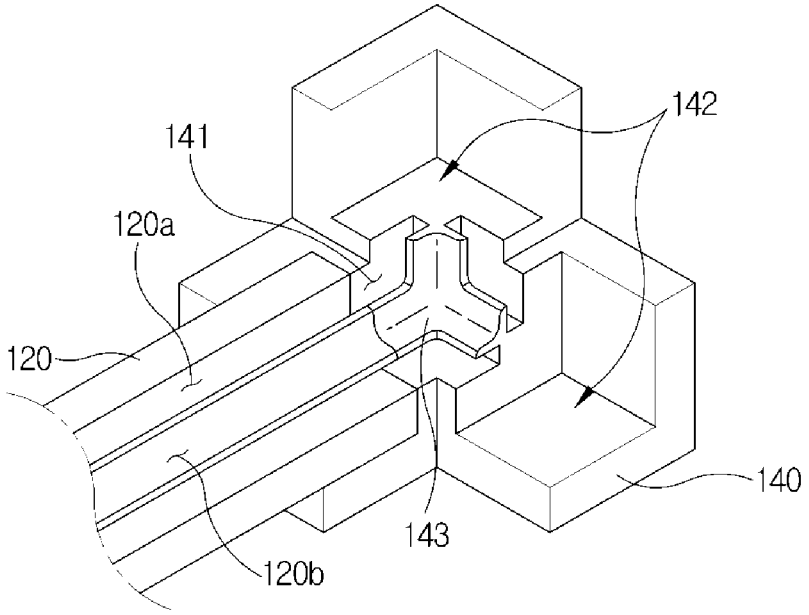
FIG. 11 is a perspective view of an inner case of a refrigerator according to another embodiment of the present disclosure.

As shown in FIGS. 5 and 10, the cover member 130 may be provided in the front part of the inner case 100 defined by the plates 110, the frames 120, and the joints 140.

The cover member 130 may have an opening of a hollow shape to form the opening of the inner case 100, thereby forming the front part of the inner case 100.

The front part of the cover member 130 may become a part of an external appearance of the front part of the refrigerator when the refrigerator door is opened/closed, and the rear part of the cover member 130 may contact the plates 110 and the frames 120 to support the front parts of the plates 110 and the frames 120.

The front part of the cover member 130 may form the front part of the inner case 100, and include a flange part 133 extending from the front part of the inner case 100 to the outside. The flange part 133 may be covered by the outer case 13 not to be exposed to the outside of the refrigerator, and embedded and fixed in an insulator foamed between the inner case 100 and the outer case 13.

The flange part 133 may include a bent part 134 formed concavely around the opening, and a hot pipe (not shown) penetrating the front part of the refrigerator may be assembled in the bent part 134.

On the rear part of the cover member 130 may be disposed a plurality of first supporting parts 131 to support the plates 110. More specifically, since the inner case 100 is formed in the shape of a six-sided object, and four plates 110 are coupled in the shape of a rectangle with respect to the front part of the inner case 100, four first supporting parts 131 may be arranged in the shape of a rectangle to correspond to the four plates 110.

The first supporting parts 131 may be, like the first supporting grooves 141 of the joints 140, provided as space into which the areas of the plates 110 not covered by the frames 120 upon coupling of the plates 110 and the frames 120 are inserted.

That is, the front edges of the upper plate 111, the lower plate 112, and the pair of the side plates 113 may be inserted into the cover member 130 through the first supporting parts 131.

More specifically, the front edges of the upper plate 111, the pair of the side plates 113, and the lower plate 112 may be inserted into and supported by the first supporting parts 131.

On the rear part of the cover member 130 may be provided a plurality of second supporting parts 132 to support the frames 120 coupled with the plates 110.

The second supporting parts 132 may be provided in the shape of protrusions protruding from the rear part of the cover member 130. The second supporting parts 132 may include bent parts bent at right angles so that the bent parts contact the outer surfaces of the frames 120 to support the frames 120.

Since the inner case 100 is formed in the shape of a six-sided object, and four plates 110 are coupled in the shape of a rectangle with respect to the front part of the inner case 100, four frames 120 coupled with the four plates 110 may be located in the front part of the inner case 100.

Accordingly, four second supporting parts 132 may be provided to correspond to the four frames 120. More specifically, the outer surfaces of the front ends of the pair of the upper frames 121 and the front ends of the pair of the lower frames 122 may contact the four second supporting parts 132, respectively.

As shown in FIG. 7, an inner case 100' according to another embodiment of the present disclosure may further include a plurality of uneven parts 115' arranged on a plurality of plates 110'.

The uneven parts 115' may be arranged on the plates 110' located in both sides of the inner case 100', and may function as protrusions for supporting a plurality of shelves 25 (see FIG. 2). The uneven parts 115' may be provided to support a plurality of shelves 25 having various sizes or a storage container 27 (see FIG. 2).

Also, the plates 110' may include curved surfaces, unlike the plates 110, and may also include patterns for satisfying a user's esthetic sense.

An inner case according to the related art has been formed as one body, and accordingly, the inner case has been manufactured by vacuum molding. Due to the limitation in the manufacturing process, the inner case has been formed with an Acrylonitrile Butadiene Styrene (ABS) resin.

However, the inner cases 100 and 100' according to the embodiments of the present disclosure are configured with the plurality of plates 110 and 110' forming the faces of the inner cases 100 and 100', as shown in FIGS. 4A and 7.

Accordingly, the inner cases 100 and 100' can be manufactured with the plurality of plates 110 and 110' molded separately, without having to be formed as one body. Accordingly, the plates 110 and 110' may be molded by various kinds of molding methods other than vacuum molding.

The plates 110 and 110' can be formed with various materials other than the ABS resin since the plates 110 and 110' can be easily molded.

Accordingly, the inner cases 100 and 100' can be manufactured with various materials, unlike the inner case according to the related art, which may lead to an improved external appearance.

Figure 12:
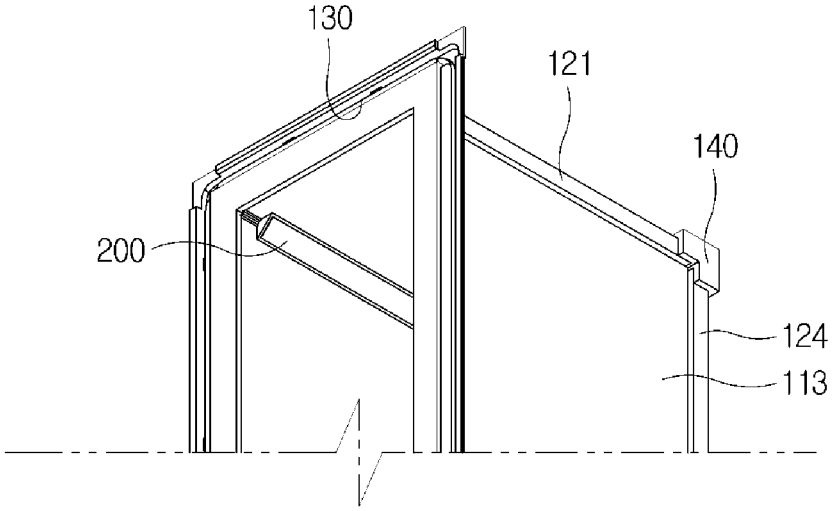
FIG. 12 is an enlarged perspective view showing a part of a refrigerator inner case according to an embodiment of the present disclosure.
Figure 13:
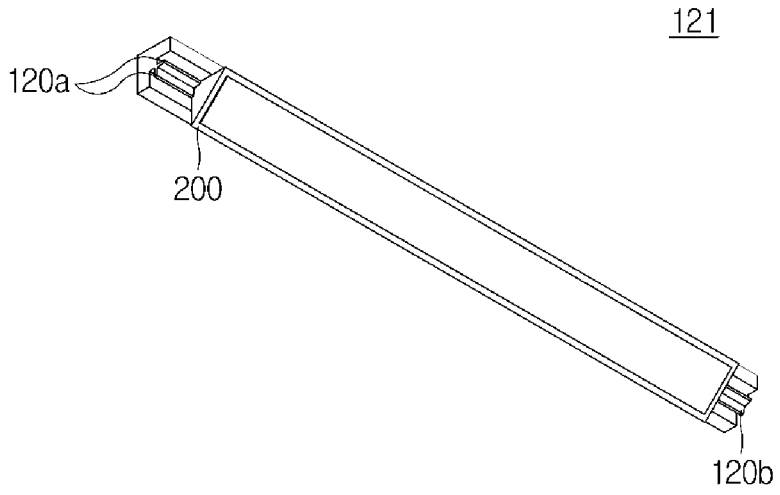
FIG. 13 is a perspective view of an upper frame of a refrigerator inner case according to an embodiment of the present disclosure.
Figure 14:
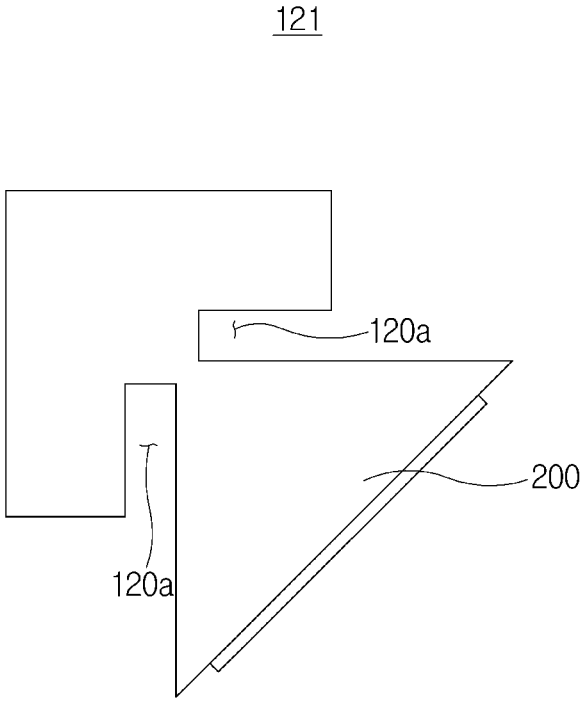
FIG. 14 is a front view of an upper frame of a refrigerator inner case according to an embodiment of the present disclosure.

A plurality of lighting devices 100 extending toward the inner area of the inner case 100 may be disposed on the frames 120, as shown in FIGS. 12 to 14.

The lighting devices 200 may be Light-Emitting Diode (LED) lightings.

The lighting devices 200 may be disposed on the first exposed parts 120*b* of the frames 120 exposed to the inside of the inner case 100. Also, the lighting devices 200 may be integrally injection-molded with the frames 120.

If the lighting devices 200 are integrated with the frames 120, another lighting member does not need to be installed in the inside of the inner case 100. Accordingly, it is possible to reduce the number of components, to facilitate manufacturing of a refrigerator, and to increase the storage capacity of the inner case 100 since the lighting devices 200 are arranged at the corners of the inner case 100 which can be considered as dead space.

The lighting devices 200 may be disposed on the first exposed parts 120*b* of the upper frames 121. The lighting devices 200 may be disposed to face downward in the inner case 100 so that light can be uniformly transferred to the inside of the inner case 100.

However, the lighting devices 200 may be additionally provided on the lower frames 122 or the back frames 123*a*, 123*b*, and 124. Also, the lighting devices 200 may be disposed on the other frames 122, 123*a*, 123*b*, and 124, instead of the upper frames 121.

Hereinafter, the order in which the inner case 100 is assembled will be described. However, the order in which the inner case 100 is assembled is not limited to the following embodiment, and can be partially changed.

First, the upper plate 111, the lower plate 112, and the pair of the side plates 113 may be disposed to form the shape of a six-sided object, and the upper frames 121 may be disposed between the upper plate 111 and the pair of the side plates 113 so that both side edges of the upper plate 111 and the upper edges of the pair of the side plates 113 can be respectively inserted into the upper frames 121.

Also, the lower frames 122 may be disposed between the lower plate 112 and the pair of the side plates 113 so that both side edges of the lower plate 112 and the lower edges of the pair of the side plates 113 can be respectively inserted into the lower frames 122.

Thereafter, the upper frames 121, the lower frames 122, the upper plate 111, the lower plate 112, and the side plates 113, coupled with the upper frames 121 and the lower frames 122, may be respectively coupled with the second supporting parts 132 and the first supporting parts 131 disposed on the rear part of the cover member 130.

Then, the back plate 114, and the first, second, and third back frames 123*a*, 123*b*, and 124 coupled with the four edges of the back plate 114 may be disposed behind the upper plate 111, the lower plate 112, and the back edges of the side plates 113, and the back edges of the upper plate 111, the lower plate 112, and the side plates 113 may be coupled with the first, second, and third back frames 123*a*, 123*b*, and 124.

Finally, the upper joints 145 may be coupled with the back ends of the upper frames 121, both ends of the first back frame 123*a*, and the upper ends of the third back frames 124, and the lower joints 146 may be coupled with the back ends of the lower frames 122, both ends of the second back frame 123*b*, and the lower ends of the third back frames 124, thereby assembling the inner case 100.

According to the embodiments of the present disclosure, since the inner case of the refrigerator can be manufactured with various kinds of materials, it is possible to add the beauty to the inner case, and to achieve a gentrified design of the refrigerator.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

an inner case having an opening and defining a storage room accessible through the opening, wherein the inner case comprises:

a plurality of plates forming faces of the inner case, the plurality of plates including at least three plates;

a plurality of frames, each disposed between two neighboring plates of the plurality of plates to support the two neighboring plates;

a plurality of joints disposed at a back part of the inner case to support the plurality of plates and the plurality of frames, each joint of the plurality of joints including three first supporting grooves supporting three plates of the plurality of plates, respectively, such that corners of the three plates are inserted into respective supporting grooves of the three first supporting grooves, and three second supporting grooves supporting three frames of the plurality of frames, respectively, such that end portions of the three frames are inserted into respective supporting grooves of the three second supporting grooves, each of the three second supporting grooves having an end that is in communication with two of the three first supporting grooves; and a cover member disposed at a front part of the inner case around the opening to cover at least one frame selected from plurality of frames or at least one plate selected from the plurality of plates, the cover member including a plurality of first supporting parts respectively supporting the plurality of plates disposed on a rear portion of the cover member, the plurality of plates being in contact with the plurality of first supporting parts, and a plurality of second supporting parts protruded from the rear portion of the cover member, respectively supporting the plurality of frames, and including bent parts in contact with outer surfaces of the plurality of frames to support the plurality of frames.

2. The refrigerator according to claim 1, wherein, for each of the plurality of frames, the frame comprises two insertion grooves to respectively receive the two neighboring plates of the plurality of plates so that the neighboring plates are supported by the frame.

3. The refrigerator according to claim 2, wherein, for each of the plurality of frames, the two insertion grooves are at a right angle with each other.

4. The refrigerator according to claim 2, wherein, for each of the plurality of frames, the frame extends along a longitudinal direction of an edge, of one of the two neighboring plates, inserted into the frame, and the two insertion grooves of the frame are formed along the longitudinal direction along which the frame extends.

5. The refrigerator according to claim 1, wherein the plurality of plates are among five plates included in the refrigerator, the five plates include:

an upper plate and a lower plate respectively forming an upper part and a lower part of the inner case;

two side plates respectively forming both side parts of the inner case; and a back plate forming a back part of the inner case, the plurality of frames are among eight frames included in the refrigerator, and the eight frames are respectively disposed between the upper plate, the lower plate, and the side plates to support the plurality of plates.

6. The refrigerator according to claim 5, wherein the eight frames are respectively disposed between the upper plate, the lower plate, the side plates, and the back plate to support the five plates.

7. The refrigerator according to claim 1, wherein each frame of the plurality of frames further comprises an exposed part exposed to the inside of the inner case, and the refrigerator further comprises a lighting device disposed on the exposed part of at least one frame of the plurality of frames.

8. The refrigerator according to claim 7, wherein the lighting device is integrated with the at least one frame.

9. The refrigerator according to claim 7, wherein the at least one frame on which the lighting device is disposed is located at an upper part of the inner case.

10. The refrigerator according to claim 1, wherein the cover member comprises, on a rear part of the cover member:

a first supporting part into which the at least one plate selected from the plurality of plates is inserted and supporting the at least one plate; and a second supporting part supporting the at least one frame selected from the plurality of frames.

11. The refrigerator according to claim 1, wherein the cover member further comprises a flange part extending outward from the opening of the inner case to an outside of the inner case.

12. The refrigerator according to claim 1, wherein, for each joint of the plurality of joints, the three first supporting grooves of the joint are formed at right angles with respect to each other.

13. The refrigerator according to claim 1, wherein at least one frame of the plurality of frames further comprises an exposed part exposed to the inside of the inner case, and the exposed part has a concave curvature facing the inside of the inner case.

14. A refrigerator comprising:

an inner case defining a storage room, wherein the inner case comprises:

a plurality of plates disposed to form faces of the inner case, the plurality of plates including at least four plates;

a plurality of frames, each connecting two neighboring plates among the plurality of plates to form corners between the plurality of plates, the plurality of frames including at least five frames; and a plurality of joints disposed at a back part of the inner case to support the plurality of plates and the plurality of frames, each joint of the plurality of joints including three first supporting grooves supporting three plates of the plurality of plates, respectively, such that corners of the three plates are inserted into respective supporting grooves of the three first supporting grooves, and three second supporting grooves supporting three frames of the plurality of frames, respectively, such that end portions of the three frames are inserted into respective supporting grooves of the three second supporting grooves, each of the three second supporting grooves having an end that is in communication with two of the three first supporting grooves.

15. The refrigerator according to claim 14, wherein for each of the plurality of frames, the frame comprises two insertion grooves to respectively receive the two neighboring plates of the plurality of plates so that the neighboring plates are supported by the frame.

16. The refrigerator according to claim 15, wherein, for each of the plurality of frames, the two insertion grooves are at a right angle with each other.

17. The refrigerator according to claim 14, wherein the plurality of frames are disposed between the plurality of plates at an upper part of the inner case, and the plurality of frames disposed at the upper part of the inner case comprise a lighting device facing toward an inner part of the inner case.

18. The refrigerator according to claim 17, wherein the lighting device is integrated with the plurality of frames disposed at the upper part of the inner case.

19. The refrigerator according to claim 14, wherein the inner case further comprises a cover member disposed in a front part of the inner case to support the plurality of plates.

20. The refrigerator according to claim 19, wherein a supporting part is formed in a rear part of the cover member to support the plurality of plates and the plurality of frames.

21. The refrigerator according to claim 13, further comprising:

a cover member disposed in a front part of the inner case to cover the plurality of frames and the plurality of plates; and a lighting device disposed on a part of one of the plurality of frames and integrated with the one of the plurality of frames.

22. A refrigerator comprising:

an inner case having an opening and defining a storage room accessible through the opening, wherein the inner case comprises:

a plurality of plates, including an upper plate forming an upper part of the inner case, a lower plate forming a lower part of the inner case, side plates forming both side parts of the inner case, and a back plate forming a back part of the inner case;

a plurality of frames, including a pair of upper frames disposed between the upper plate and the side plates to support both side edges of the upper plate and to support the side plates, a pair of lower frames disposed between the lower plate and the side plates to support both side edges of the lower plate and to support the side plates, and a back frame disposed between the back plate and another plate, selected from the upper plate, the lower plate, and one of the side plates, to support the back plate and the another plate; and a plurality of joints disposed at a back part of the inner case to support the plurality of plates and the plurality of frames, each joint of the plurality of joints including three first supporting grooves supporting three plates of the plurality of plates, respectively, such that corners of the three plates are inserted into respective supporting grooves of the three first supporting grooves, and three second supporting grooves supporting three frames of the plurality of frames, respectively, such that end portions of the three frames are inserted into respective supporting grooves of the three second supporting grooves, each of the three second supporting grooves having an end that is in communication with two of the three first supporting grooves.

23. The refrigerator according to claim 22, wherein at least one of the upper frames comprises a lighting device integrated with the at least one of the upper frame.

* * * * *